US008337970B2

(12) United States Patent
Pfister

(10) Patent No.: US 8,337,970 B2
(45) Date of Patent: Dec. 25, 2012

(54) ARMOUR REPAIR SYSTEM

(75) Inventor: Karl Gerhard Pfister, Thorndale (CA)

(73) Assignee: Armatec Survivability Corporation, Ontario (CA)

( * ) Notice: Subject to any disclaimer, the term of this patent is extended or adjusted under 35 U.S.C. 154(b) by 304 days.

(21) Appl. No.: 12/669,473

(22) PCT Filed: Jul. 18, 2007

(86) PCT No.: PCT/CA2007/001288

§ 371 (c)(1),
(2), (4) Date: Jun. 14, 2010

(87) PCT Pub. No.: WO2009/009855

PCT Pub. Date: Jan. 22, 2009

(65) Prior Publication Data

US 2011/0177276 A1 Jul. 21, 2011

(51) Int. Cl.

| | |
|---|---|
| ***B32B 9/00*** | (2006.01) |
| ***F41H 1/02*** | (2006.01) |
| ***F41H 5/00*** | (2006.01) |
| ***F41H 5/02*** | (2006.01) |

(52) U.S. Cl. ..... 428/40.4; 428/40.1; 428/41.8; 2/2.5; 2/455; 2/456; 2/467; 89/36.01; 89/36.02; 89/36.05

(58) Field of Classification Search ..... 428/40.1, 428/41.7, 41.8; 2/2.5, 455, 456, 459, 463–467, 2/410; 89/36.01, 36.02, 36.05
See application file for complete search history.

(56) References Cited

U.S. PATENT DOCUMENTS

| | | | | |
|---|---|---|---|---|
| 5,259,549 | A | 11/1993 | Loew | |
| 2009/0293711 | A1 * | 12/2009 | Altergott et al. | 89/36.02 |

* cited by examiner

*Primary Examiner* — Patricia Nordmeyer
(74) *Attorney, Agent, or Firm* — McNeely, Hare & War LLP; Kevin J. McNeely

(57) ABSTRACT

The armour repair patch uses a simplified adhesive system for securement of the repair patch in the field without specialized equipment. A preferred adhesive system includes a pressure sensitive adhesive provided on a back surface of a body member and a fabric overlay cover is and extending beyond the body member. This combination provides an effective system for battlefield repair.

15 Claims, 3 Drawing Sheets

ARMOUR REPAIR SYSTEM

TECHNICAL FIELD

The present invention is directed to the repair of armour vehicles or armour plates. In particular, the invention is directed to a battlefield repair patch and patch system that can be applied quickly and without specialized skill and can be used on both metallic and composite type armour systems.

BACKGROUND OF THE ART

It is often necessary in modern warfare to provide a battlefield repair to damaged armour plate of armour vehicles. Once an armour plate has received damage, it becomes a focus for subsequent attacks as the area may already be perforated or certainly weakened. It is important to be able to complete a battlefield repair in a simple and effective manner even if the repair is essentially temporary, until the armour panel can be replaced or repaired in a more permanent manner.

It is certainly known to weld repair patches to metallic armour panels, however, this requires specialized equipment and skill that is not normally available on the battlefield. The process is also time consuming and has not proven particularly effective. This process is also not applicable to composite armour systems or vehicles.

U.S. Pat. No. 5,259,549 discloses a method to attach a repair patch to an armour plate by securing of a series of specialized hollow cylinder elements that can be welded to the armour plate by means of an oxygen lance. Once these cylinders have been appropriately attached to the plate, they provide a suitable means for mechanically securing of an armour repair patch to the armour plate. Basically, the armour repair patch has a series of ports and these cylinders in the preferred embodiment pass through the ports in the repair patch. The cylinders include a threaded portion on the exterior thereof and thus, the repair patch can be mechanically fastened to the armour plate by a nut and bolt type connection.

This patent also discloses an arrangement for providing a temporary weld of the armour plate to the vehicle.

The system of U.S. Pat. No. 5,259,549 is directed to battlefield repair of armour plate, however, this system still requires specialized equipment and skill to complete the battlefield repair. This repair would also be somewhat time consuming and could not be used to repair a composite armour panel or vehicle.

The present invention provides a convenient simplified approach for repair of damaged armour plate that can be carried out quickly and without specialized skill. This armour plate can be part of or additional panels carried by an armour vehicle.

SUMMARY OF THE INVENTION

An armour patch repair systems for repairing armour substrates of an armour vehicle or associated therewith according to the present invention comprises a series of pre-manufactured patches of different sizes where each patch is of a composite construction. Each patch includes an armour body member, a fabric layer extending over a top surface of the body member and beyond the sides thereof, and adhesive layer on a bottom surface of the armour body member and a bottom surface of the fabric layer and a removable protective layer covering the adhesive layer. The removable protective layer is removed when said patch is to be adhesively secured to an armour substrate.

An armour patch repair system according to an aspect of the invention includes generally planar patches for securement to a flat armour panel or armour substrate, corner patches for securement to two armour panels at a corner junction therebetween and contoured patches for securement to a curved armour substrate.

In a different aspect of the invention, the series of patches include at least some tapered edge patches. The body member of each tapered edge patch has at least some tapered side edges defining a bottom surface of said body member that is larger in area relative to the top surface of the body member.

In a further aspect of the invention, the series of patches include at least some straight edge patches. The body member of each straight edge patch has at least some straight side edges allowing straight edge abutment of two straight edge patches.

In a preferred aspect of the invention, the fabric layer is adhesively secured to and overlays side edges of the body member of the patches.

In an aspect of the invention, the series of patches include corner patches, contoured patches and different shaped planar patches.

In a further aspect of the invention at least some of the patches are shaped to cooperate with other patches to cooperatively repair a damaged area of a size greater than the area any one of the patches can individually repair.

An armour repair patch system according to the invention is of a composite construction comprising an armour body member, a fabric layer extending over a top surface of the body member and beyond the sides thereof. An adhesive layer is provided on a bottom surface of the armour body member and a bottom surface of the fabric layer. A removable protective layer covers the adhesive layer and is removable by peeling thereof to expose the adhesive layer and allow adhesive securement of the patch across a damaged area of an armour plate or vehicle.

BRIEF DESCRIPTION OF THE DRAWINGS

Preferred embodiments of the invention are shown in the drawings, wherein.

DETAILED DESCRIPTION OF A PREFERRED EMBODIMENT

Figure 1:
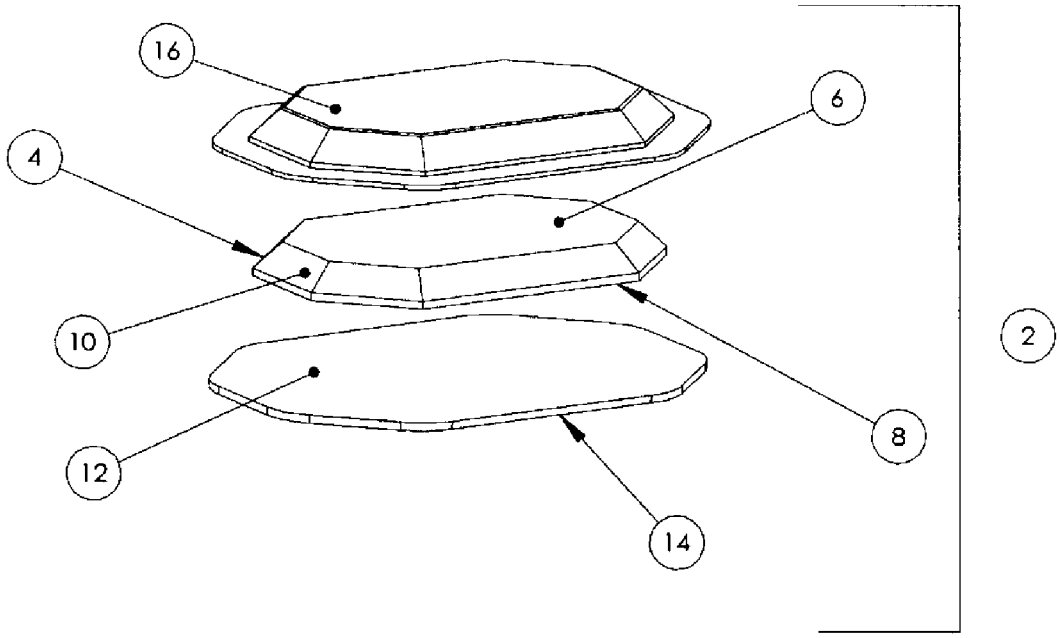
FIG. 1 is an exploded perspective view of the repair patch of the present invention.
Figure 2:
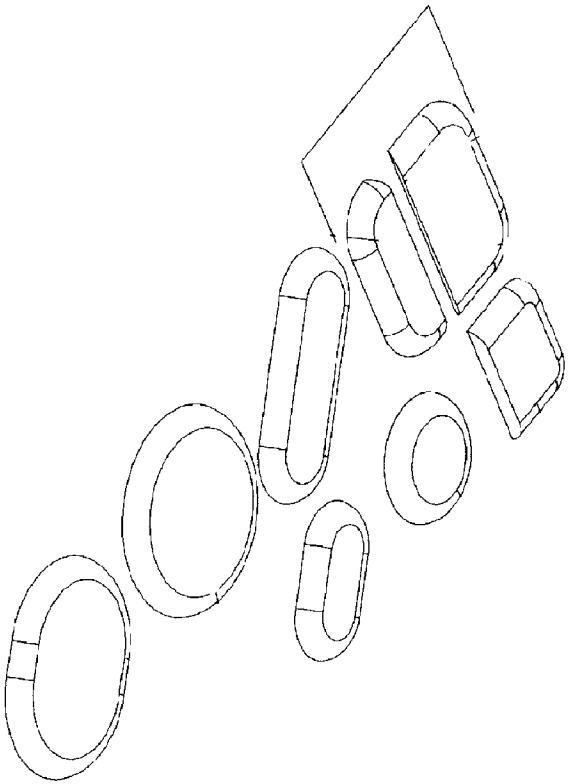
FIG. 2 is a perspective view of a series of body members of different shapes used in the repair patch system.

The repair patch 2, as shown in FIG. 1, includes a body member 4, preferably of a ceramic plate type material that is applied over a damaged portion of an armour plate. Basically, the body member will extend across the damaged area and is typically supported by the armour plate about the damaged area. The body member traverses and covers the damaged area and has edge support typically about the entire periphery body member. For example, an eight inch diameter patch may include a six inch diameter body member suitable for repairing an armour plate having a damaged hole of approximately two to three inches.

The repair kit preferably includes a series of different repair patches with some of these patches specialized for corner repair of armour plate and others for repair of planar sections of armour plate. The series of patches are of different sizes whereby the appropriate patch can be selected for the particular damaged area.

The repair patch 2 shown in FIG. 1 includes the body member 4 having a top surface 6 and a bottom surface 8. The sides of the body member 4 preferably include tapered sidewalls 10. These tapered sidewalls improve securement of the oversized fabric layer 16 to the sidewalls with this fabric layer extending beyond the sidewalls. The bottom surface 8 of the body member 4 includes the adhesive layer 12. In addition, the adhesive layer 12 extends beyond the sidewalls 10 and engages the oversized fabric layer 16. The lower surface of the adhesive layer 12 includes a removable protective layer 14. This layer 14 is easily separated from the adhesive layer by hand and without tools to expose the adhesive layer 12 for securement to armour plate as generally shown in FIG. 3.

Preferably, the relationship of the adhesive layer 12 and the releasable protective layer 14 is well known and commonly used with respect to pressure sensitive tapes, labels and other pressure sensitive adhesive applications.

Figure 3:
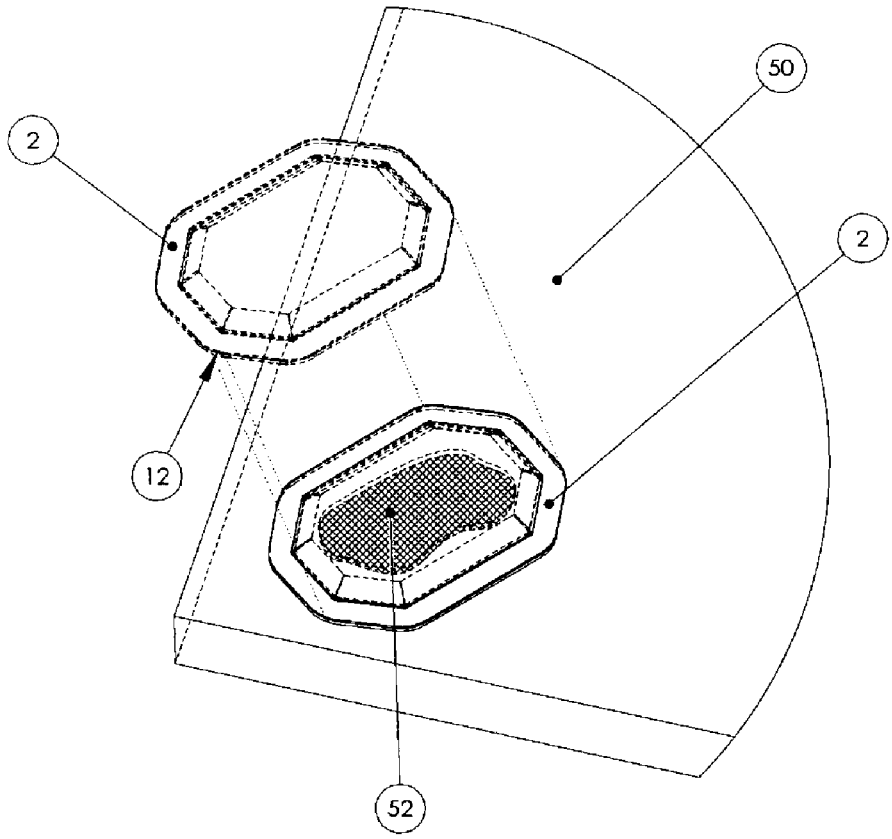
FIG. 3 is a partial perspective view showing a damaged armour plate being repaired by a repair patch.

In order to repair a damaged plate shown as 50 in FIG. 3, an appropriate repair patch is chosen from the repair kit where the body of the repair patch will cover the hole 52 in the damaged plate 50. As can be appreciated, the hole 52 might only be a partially torn recess or indentation and need not be a perforation. Once the appropriate size of repair patch has been selected, the area of the armour plate about the hole 52 may be quickly cleaned to remove dirt or other contamination that would reduce the strength of the adhesive securement of the repair patch to the damaged plate 50. Once this has been accomplished, the protective layer 14 is removed from the adhesive layer 12 and the repair patch is appropriately placed over the hole with the repair patch pressed against the damaged plate 50 to effect securement by the adhesive layer 12. The adhesive layer 12 is typically a pressure sensitive adhesive and a strong securement of both the ceramic body 4 and the oversized fabric layer 16 to the armour plate is achieved.

The preferred embodiment of the present invention is a pressure sensitive adhesive where the adhesive layer is covered by the protective layer 14. In this way, the protective layer is removed and the repair patch pressed onto the damaged plate 50. As can be appreciated, this field repair can be completed quickly and does not require any specialized skill. Additional chemicals for cleaning of the area about the damaged area of the plate, may be provided as part of the kit, to improve the adhesive securement of the repair patch to the damaged plate. It is possible to apply a first adhesive layer to the damaged plate about the hole 52 that cooperates with a second adhesive layer of the armour patch such that it is brought into contact with the first layer provided on the armour plate. These two layers can cooperate with the underlying armour substrate to positively secure and maintain the repair patch in position. The present repair patch is a system does not require specialized tools or user expertise to complete an armour plate repair.

The repair kits can be provided in appropriate colors for blending with the armour plate for which they are intended to be used. It is desirable to have the repair patch blend with the armour plate to reduce the possibility of a subsequent focused attack on the damaged area.

The battlefield repair patch of the present invention utilizes pre-manufactured patches that are easily applied in the field without specialized training or equipment. Preferably, a repair patch kit is provided having a series of different pre-manufactured patches of different sizes and shapes for repair of different damaged area. Corner or edge patches are provided as well as a series of straight edge patches where patches may be abutted to cover a larger damaged area. The adhesive securement of the repair patch to a damaged area is easily accomplished and the actual size of the repair kit is space efficient. This repair patch system is applicable for base line armour repair without welding as well as the repair of add-on armour panels. The patches include a pre-finish and thus do not require painting in the field. The repair patches are relatively lightweight and preferably include a ceramic composite armour body member. As outlined above the repair patches can be sized and shaped to allow cooperation therebetween for repair of a larger area.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An armour patch repair system comprising:

a series of pre-manufactured patches of different shapes and sizes;

wherein each patch is of a composite construction including an armour body member, a fabric layer extending over a top surface of said body member and beyond the sides thereof, an adhesive layer on a bottom surface of said armour body member and a bottom surface of said fabric layer, and a removable protective layer covering said adhesive layer that is removed when said patch is to be adhesively secured to damaged armour substrate.

2. An armour patch repair system as claimed in claim 1 wherein said series of pre-manufactured patches include generally planar patches for securement to a flat armour substrate, and corner patches for securement to two armour substrates at a corner junction therebetween.

3. An armour patch repair system as claimed in claim 1 wherein said series of premanufactured patches include contoured patches for repaid of a curved armour substrate.

4. An armour patch repair system as claimed in claim 3 wherein said fabric layer is adhesively secured to and overlays side edges of the body member of said patches.

5. An armour patch repair system as claimed in claim 1 wherein said series of patches include at least some tapered edge patches, said body member of each tapered edge patch having at least some tapered side edges defining a bottom surface of said body member that is larger in area relative to said top surface of said body member.

6. An armour patch repair system as claimed in claim 1 wherein said series of patches include at least some straight edge patches, said body member of each straight edge patch having at least some straight side edges allowing straight edge abutment of two straight edge patches.

7. An armour patch repair system as claimed in claim 1 wherein said series of patches include corner patches and different shaped planar patches.

8. An armour patch repair system as claimed in claim 1 wherein at least some of said patches are shaped to cooperate with other patches to cooperatively repair a damaged area of a size greater than the area any one of said patches can individually repair.

9. An armour repair system as claimed in claim 1 wherein said fabric layer is of a color for repair of a similarly colored armour panel.

10. An armour repair system as claimed in claim 1 wherein the body member of at least some of said repair patches is of a ceramic composite material.

11. An armour repair patch of a composite construction comprising an armour body member, a fabric layer extending over a top surface of said body member and beyond the sides thereof, an adhesive layer on a bottom surface of said armour body member and a bottom surface of said fabric layer and a removable protective layer covering said adhesive layer, said protective layer being removable to expose said adhesive layer and adhesively secure said repair patch across a damaged area of an armour substrate requiring repair.

12. An armour repair patch as claims in claim 11 wherein said armour body member comprises a ceramic plate material.

13. An armour repair patch as in claim 11 wherein said armour body member includes tapered side edges and said fabric layer is secured to said top surface and said tapered side edge of said armour body member.

14. An armour repair patch as claimed in claim 11 wherein patch is a corner patch, said body armour member including two plate segments joined at a corner junction.

15. An armour repair patch as claimed in claim 11 wherein fabric layer extends beyond said body member at least two inches.

* * * * *